United States Patent [19]

Monot

[11] 4,188,752

[45] Feb. 19, 1980

[54] OBLIQUE-DISPLACEMENT SLIDING DOOR

[75] Inventor: Bernard Monot, Aubervilliers, France

[73] Assignee: Faiveley S.A., Saint Ouen, France

[21] Appl. No.: 882,216

[22] Filed: Feb. 28, 1978

[30] Foreign Application Priority Data

Apr. 13, 1977 [FR] France ..... 77 11095

[51] Int. Cl.[2] ..... E05D 15/10

[52] U.S. Cl. ..... 49/218; 49/362

[58] Field of Search ..... 49/210–225, 49/362

[56] References Cited

U.S. PATENT DOCUMENTS 4,000,582 1/1977 Monot ..... 49/218

*Primary Examiner*—Philip C. Kannan

*Attorney, Agent, or Firm*—Young & Thompson

[57] ABSTRACT

The sliding door is constituted by at least one door-leaf which is stabilized by two parallel toothed racks disposed in meshing engagement with two pinions, the pinions being coupled together by means of a coordinating shaft surrounded by a connecting tube. Two crank-arms attached to the tube are pivotally mounted on a stationary structure which is attached to the door-frame. Operating means comprising a rotary motor and a mechanism for driving the pinions of the leaf-stabilizing system are rigidly fixed to at least one crank-arm, the motor being associated with an auxiliary pinion which is in mesh with one of the stabilizing pinions.

5 Claims, 5 Drawing Figures

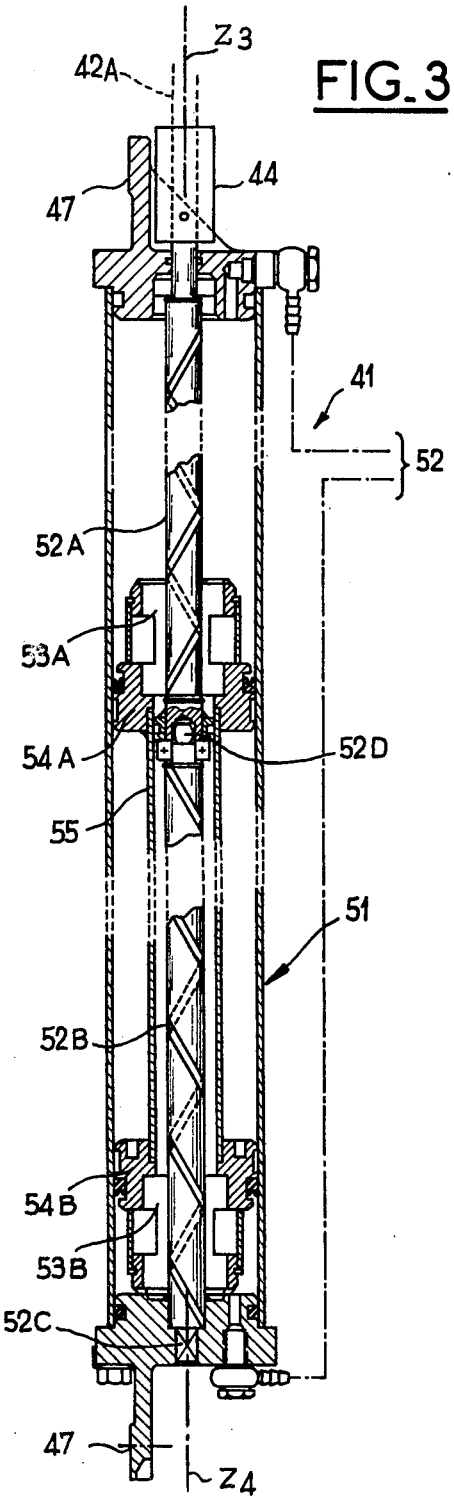
FIG. 3
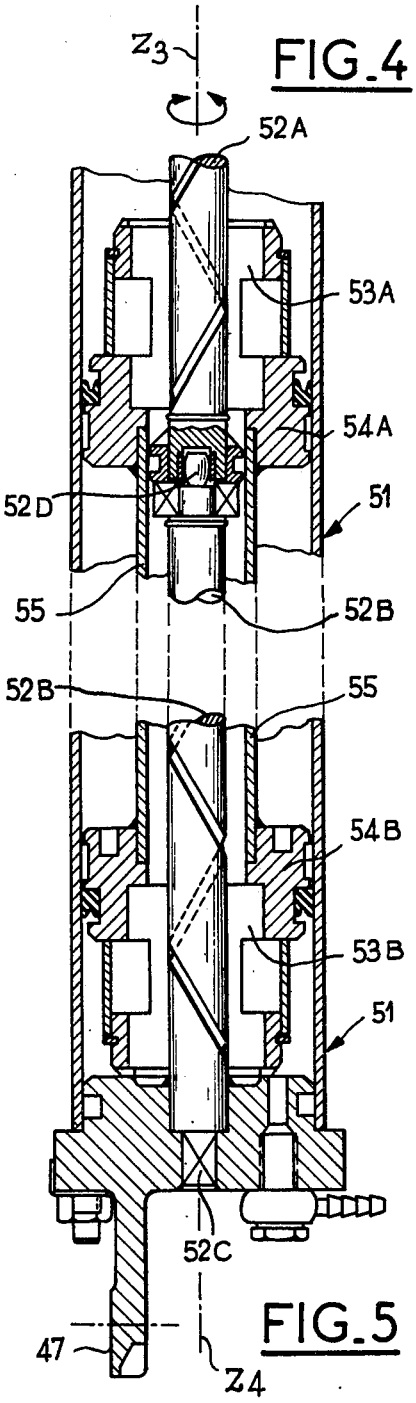
FIG. 4
FIG. 5

OBLIQUE-DISPLACEMENT SLIDING DOOR

This invention relates to an oblique-displacement sliding door comprising a stationary frame and at least one sliding leaf associated with guiding means attached to the frame for engaging the leaf transversely within the frame in the closed position and for disengaging said leaf in the opposite direction at the beginning of the opening movement. Operating means are associated with the leaf in order to displace this latter in the direction of sliding motion.

A sliding door of the type mentioned above is already known and was disclosed in U.S. Pat. No. 4,000,582. The door described in this patent comprises in addition a leaf-stablizing system in which provision is made on the leaf for two separate toothed racks which are parallel to the direction of sliding motion and each associated with a pinion supported by a carriage retained by a guide which is parallel to the toothed rack. The two pinions just mentioned are coupled by means of a coordinating shaft which is placed transversely with respect to the guides. The stabilizing system also comprises two articulated crank-arms each having one end connected to a carriage and the other end connected to the door-frame. The axes of the two articulations for pivotally mounting the ends of each crank-arm on the frame are substantially coincident and parallel to the coordinating shaft.

The operating means comprise a motor and a mechanism for driving the pinions of the leaf-stabilizing system in rotation. The motor and the drive mechanism are rigidly fixed to at least one of the crank-arms which are pivotally mounted on the stationary frame of the door.

Depending on the space available in vehicles for equipping the oblique-displacement sliding door of the type mentioned in the foregoing, certain difficulties are liable to arise in particular from the need to minimize the bulk of the motor and the mechanism employed for driving the pinions of the stabilizing system.

It is in fact desirable to ensure that the motor and the mechanism aforesaid can be housed within the space limits defined by the stationary frame provided for receiving the door-leaf in the closed position. Furthermore, it is necessary for the convenience of users to ensure that the maximum frame clearance is offered by the door-leaf in the open position.

Moreover, the motor and drive mechanism must offer highly smooth operation, especially in order to permit operation of the door-leaf by hand under emergency conditions, namely when the motor is inoperative.

The aim of the present invention is to meet the difficulties and conditions outlined in the foregoing by making it possible to construct a door of the aforementioned type which is of small overall size and offers high smoothness of operation, especially for emergency operations performed by hand.

In accordance with the invention, the door of the aforementioned type is distinguished by the fact that the motor for driving the pinions of the leaf-stabilizing system is a rotary motor associated with an auxiliary pinion disposed in meshing engagement with one of the pinions mentioned earlier.

As will be explained below, these arrangements permit convenient and compact industrial design of the drive system of the door in accordance with the invention, especially by making use of a motor having an elongated shape but a small diameter and an auxiliary pinion associated with the upper stabilizing pinion of the door.

Preferably, the drive motor and auxiliary pinion are coaxial, mounted parallel to the coordinating shaft and secured to a tube for connecting the stabilizing crank-arms which surround the shaft aforesaid; at least one of the means for securing the drive motor and auxiliary pinion to the connecting shaft is constituted by one of the stabilizing crank-arms.

The rotary motor advantageously comprises a linear reciprocating-motion jack controlled by a pressurized-fluid circuit and associated with a motion converter of the revolution-multiplier type for driving the auxiliary pinion in rotation. These arrangements are particularly conducive to efficacious design both of the motor and of a mechanism of elongated shape but small overall size as will be explained hereinafter.

Further distinctive features and advantages proposed by the present invention will be brought out by the following description of a preferred embodiment which is given by way of example and not in any limiting sense, reference being made to the accompanying drawings, wherein:

FIG. 3 is a detail axial sectional view of the driving jack of FIG. 1;

FIGS. 4 and 5 are two enlarged detail views of FIG. 3 and show the two pistons of the motion converter and multiplier which are mounted within the jack body.

Figure 1:
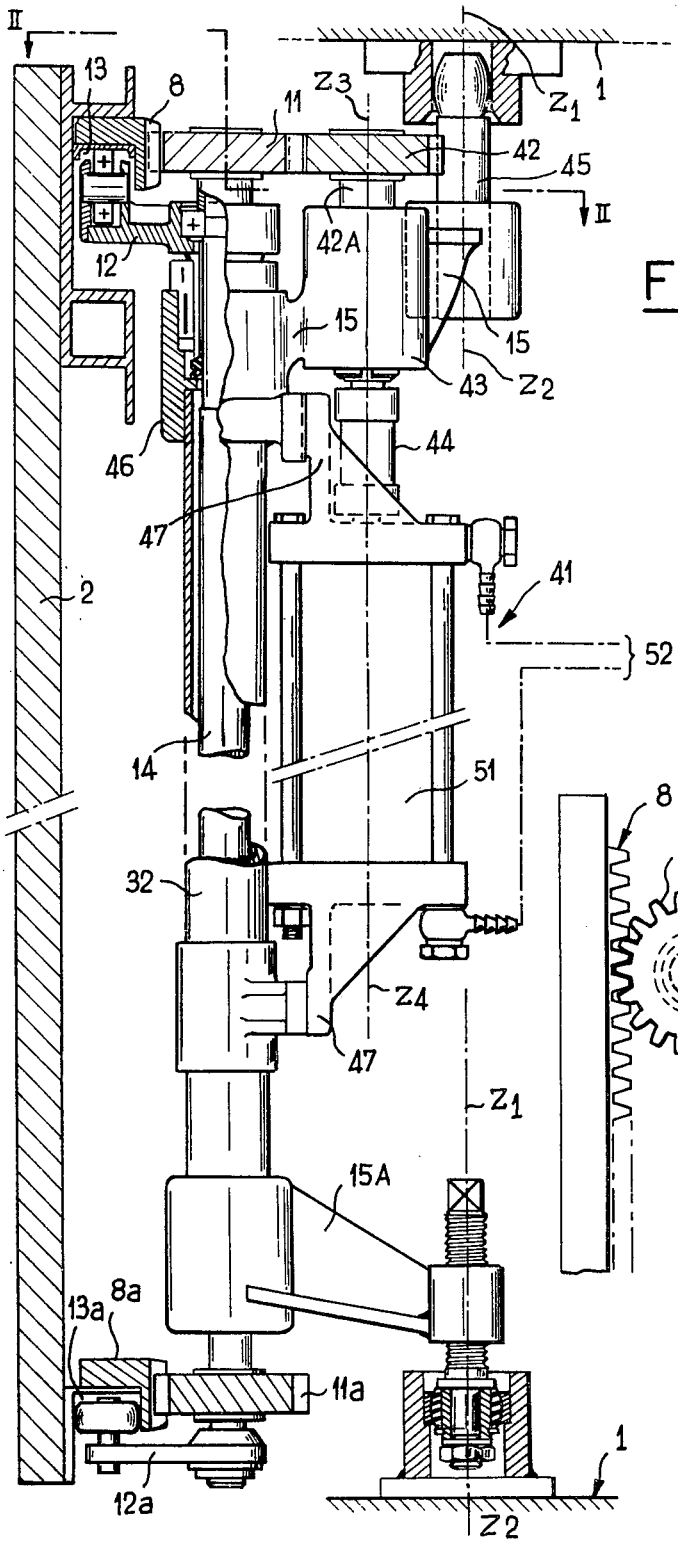
FIG. 1 is a general schematic view in elevation of the door-operating mechanism in accordnce with the present invention.
Figure 2:
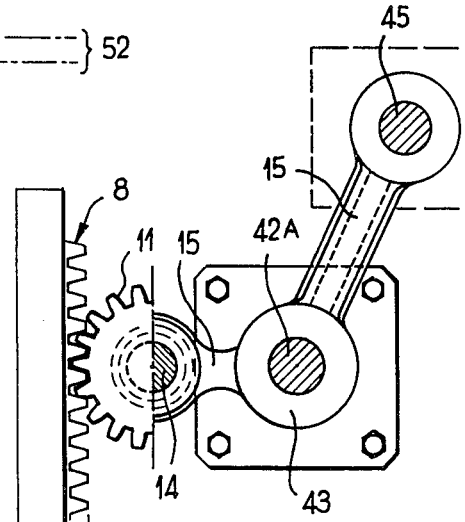
FIG. 2 is a sectional view along line II—II of FIG. 1 showing the upper stabilizing crank-arm which couples the auxiliary pinion with the connecting tube of the two crank arms.

In the embodiment shown in FIGS. 1 to 5, the oblique-displacemment sliding door has a stationary frame (not shown in the drawings) which is rigidly fixed to a structure 1 (shown in FIG. 1). A sliding leaf 2 is associated with guiding means (not shown in the figures), said means being attached to the door-frame in order to engage the leaf 2 in the frame in the closed position and to disengage said leaf in the opposite direction at the beginning of opening. Actuating means described hereinafter are provided for displacing the door-leaf 2 in the direction of sliding motion of this latter. As shown in FIG. 1, the door is equipped with a leaf-stabilizing system which is provided on the leaf with two toothed racks 8, 8*a* in spaced relation. Said racks are parallel to the direction of sliding motion and are each associated with a stabilizing pinion 11, 11*a* which is supported by a carriage 12, 12*a*. Said carriage is retained by a guide 13, 13*a* which is parallel to the toothed rack 8. The two stabilizing pinions 11, 11*a* are coupled together by means of a coordinating shaft 14 which is located transversely with respect to the guides 13. The leaf-stablizing system further comprises two stabilizing crank-arms 15, 15*a*, one end of each crank-arm being pivotally mounted on a carriage 12 whilst the other end is pivotally mounted on the structure 1. The axes Z1–Z2 on which the crank-arms 15, 15*a* are pivoted to the structure 1 are in substantially coincident and parallel relation to the coordinating shaft 14 (as shown in FIG. 1). Said shaft is surrounded by a tube 32 which serves to connect together the two stabilizing crank-arms 15, 15*a*.

This means for actuating the door-leaf 2 comprise a motor and a mechanism for driving the stabilizing pinions 11, 11*a* in rotation.

The motor and the mechanism for driving the pinions 11, 11*a* are coupled to at least one of the stabilizing crank-arms 15, 15*a* which are pivotally mounted on the structure 1 of the stationary frame.

In accordance with the invention and as shown in FIG. 1, the motor which drives the pinions 11, 11*a* of the stabilizing system is a rotary motor 41 associated with an auxiliary pinion 42 which is in mesh with one of the aforementined stabilizing pinions such as the upper pinion 11.

Preferably, the rotary drive motor 41 and the auxiliary pinion 42 are coaxial along an axis Z3–Z4 which is located parallel to the coordinating shaft 14 and in fixed relation to the connecting tube 32 between the stabilizing crank-arms 15, 15*a* which surround the shaft 14.

The auxiliary pinion 42 is mounted in position by means of a bearing bracket 43 which is integral with the upper crank-arm 15 and contains an antifriction bearing for guiding the shaft 42*a* of the auxiliary pinion 42. Said pinion is coupled to the drive motor 41 by means of a demountable coupling member 44.

The bearing bracket 43 of the upper crank-arm 15 is located between a shaft 45 for displacing one end of the crank-arm 15 in pivotal motion on the structure 1 which is rigidly fixed to the stationary door-frame and a bearing bracket 46 which surrounds the coordinating shaft 14 and the connecting tube 32 in the vicinity of the carriage 12 and the upper stabilizing pinion 11.

The motor 41 is mounted on the connecting tube 32 by means of two mounting arms 47 which are rigidly fixed respectively to the top and bottom ends of the motor 41 in the service position. The motor 41 can be readily removed by means of the coupling sleeve 44 and the mounting arms 47.

Preferably, the rotary motor 41 shown in FIG. 3 comprises a jack 51 of elongated design which carries out linear reciprocating motion and is controlled by a pressurized-fluid circuit 52. Said jack is associated with a motion converter combined with a revoluton multiplier for driving the auxiliary pinion 42 in rotation (as shown in FIG. 1).

As an advantageous feature which is shown in FIG. 3, the motion converter and revolution multiplier are housed within the elongated cylindrical body of the jack 51 and comprise two rods 52A, 52B which have threaded portions of opposite pitch and are coaxial with the axis Z3–Z4 of the jack body.

Each rod 52A, 52B has substantially one-half the length of the body of the jack 51 and is disposed in meshing engagement with a nut 53A, 53B which is fixed in a piston 54A, 54B. Said piston is traversed by one of the threaded rods 52 and slidably mounted within the cylindrical body of the jack 51. The two pistons 54A, 54B which are each associated with a rod 52 are rigidly coupled by means of an intermediate tube 55 which surrounds the rods 52 within the body of the jack 51 over a distance which is substantially equal to one-half the length of the jack body.

One extremity 52C of a first threaded rod 52B (shown in FIGS. 3 to 5) is rigidly fixed to the body of the jack 51 in proximity to the bottom mounting-arm 47. The other extremity 52D of the threaded rod is rotatably mounted in one extremity of the other rod 52A. The other extremity of said rod 52A is in turn rotatably mounted in the body of the jack 51 in proximity to the other end-arm 47, passes through the jack body and terminates in the coupling sleeve 44 which is connected to the shaft 42A of the auxiliary pinion 42. As shown in FIG. 1, said pinion is in mesh with the upper pinion 11 of the system for stabilizing the door-leaf 2.

In order to ensure ease of operation of the leaf-actuating mechanism under all conditions as will be explained below and in particular for emergency operation by hand, the threaded portion of each rod 52A, 52B is a screw-thread having reversible action and having a pitch of the order of 60 to 120 mm per revolution, for example, in the case of steel rods 52A, 52B having a diameter of 15 to 30 mm.

Preferably, the internal cylindrical face of the body of the jack 51 is carefully machined and polished in order to ensure smoothness of the helical movements of the pistons 54. Similarly, the threaded rods 52 are ground in order to ensure smoothness of the movements of the nuts 53. Provision can advantageously be made for ball-circuit nuts. The bearings in which the threaded rods 52 are rotatably mounted with respect to each other and within the body of the jack 51 can consist of either ball-bearings or needle-bearings, or plain bearings of hard self-lubricating plastic material or of a sintered copper alloy.

To complete the description of the leaf-actuating mechanism which has just been given with reference to FIGS. 1 to 5, the operation of the door will now be explained. It will be assumed that the pistons 54A, 54B are in the position shown in FIGS. 3 to 5. If action is accordingly produced on the control system 52 so as to initiate the displacement of the lower piston 54B towards the other end of the jack body 51, the threaded portion of the rod 52B which is engaged with the nut 53B causes the rotation of the piston 54B since the rod 52B is maintained in a stationary position at the extremity 52C which is secured within the jack body (as shown in FIG. 3).

The helical movement thus imparted to the piston 54B and corresponding to the threaded portion of the rod 52B is imparted to the upper piston 54A by means of the intermediate tube 55.

The movement of rotation of the upper piston 54A causes the rotation of the upper threaded rod 52A which is rotatably mounted on the upper end 52D of the rod 52B and within the upper passage of the jack body 51 in proximity to the coupling sleeve 44. At the same time, the translational displacement of the upper piston 54A has the effect of multiplying the number of revolutions of the upper rod 52A under the action of the nut 53A, said nut being engaged with the threaded portion of the rod 52A which is opposite to that of the lower rod 52B.

The lower rod 52B is provided by way of example with a left-hand thread (as shown in FIGS. 3 to 5), the pitch of which corresponds to four revolutions of the lower piston 54B for the permitted travel of said piston within the jack body 51. Thus the two pistons 54B, 54A which are associated by means of the intermediate tube 55 make four anticlockwise rotations in order to move from the lowermost position shown in FIG. 3 to the uppermost position (not shown). Said pistons will subsequently make four clockwise rotations in order to return downwards to the position shown in FIG. 3.

The thread pitch of the upper rod 52A is opposite to that of the lower rod 52B and corresponds for example to the same number of revolutions for the possible range of travel of the upper piston 54A.

The multiplier constituted by the two threaded rods 52A, 52B of opposite pitch and the associated nuts 53A, 53B mounted in the pistons 54A, 54B which are coupled together by means of the intermediate tube 55 thus has the effect of doubling the number of revolutions of the coupling member 44 and of the auxiliary pinion 42 (shown in FIG. 1) with respect to the number of revolutions of the coupled pistons 54 each time these latter carry out a movement within the jack body 51.

By virtue of the multiplication effect mentioned in the foregoing, the auxiliary pinion 42 which is mesh with the upper stabilizing pinion 11 (shown in FIG. 1) therefore makes eight revolutions, for example, during each full range of travel of the pistons 54A, 54B within the jack body 51, either in one direction or in the other.

This multiplication of the number of revolutions of the auxiliary pinion 42 permits an advantageous reduction in diameter of said pinion, which in turn offers the advantage of an increase in the effective driving torque applied to the stabilizing pinion 11 in respect of a given diameter of the jack 51. Moreover, the smaller diameter of the auxiliary pinion 42 is an advantage for reducing the overall transverse width of the mechanism.

For emergency hand-operation of the door-leaf 2, a changeover valve (not shown in the drawings) serves to make the pressurized-fluid circuit 52 inoperative by venting to the external atmosphere the two portions of the circuit 52 which terminate at each end of the jack 51 (shown in FIGS. 1 and 3). Under these conditions, when the door-leaf 2 is actuated by hand, the auxiliary pinion 42 is caused to rotate and the pistons 54A, 54B move freely within the body of the jack 51 by virtue of the reversible action of the threaded portions of the coaxial rods 52A, 52B.

For emergency operation of the door-leaf 2 by hand, the motion converter constituted by the threaded rods 52 associated with the nuts 53 carried by the pistons 54 perform the function of a shock-absorber or damping device for preventing excessively violent operation of the door-leaf. If necessary, it can be made possible to adjust the above-mentioned damping action by means of a leakage orifice (not shown) associated with each of the connections between the fluid-circuit 52 and the body of the jack 51. The cross-sectional area of said orifice can be adjusted in accordance with requirements by means of a point-screw, for example.

It is apparent from the foregoing description of the structure and operation of the door in accordance with the invention that this latter offers a number of advantages.

By virtue of the elongated shape of the mechanism constituted by the auxiliary pinion 42 and by the motor 41 which is preferably a jack of small diameter, the mechanism is of very small overall size in the transverse direction with respect to the coordinating shaft 14 provided for the stabilizing pinions 11. This permits easy installation of the door-operating mechanism within the general outline defined by the stationary door-frame which is rigidly fixed to the structure 1.

Similarly, the limited overall size of the door-operating mechanism in the transverse direction proves more convenient for users since this offers maximum clearance within the stationary door-frame in the open position of the leaf.

The above-mentioned reduction in overall size is further enhanced by the coaxial arrangement of the drive motor and of the auxiliary pinion which can be conveniently mounted on the connecting tube of the stabilizing crank-arms. This mounting facilitates the installation, maintenance and possible replacement of the drive motor during service.

The coaxial arrangement of the motion converter and of the multiplier for the number of revolutions of the auxiliary pinion within the jack body of the drive motor is also conductive to a reduction in overall transverse width of the mechanism and to smoothness of operation of this latter both under normal operating conditions and under conditions of emergency operation of the door-leaf when this latter is actuated by hand.

The system constituted by the two coaxial rods having threads of opposite pitch associated with two nuts carried by pistons coupled together by means of the intermediate tube which surrounds the threaded rods (as shown in FIG. 3) permits highly efficacious industrial construction of the door-operating mechanism in accordance with the invention. This mechanism offers both very smooth operation, a high degree of reliability and very small overall size.

As can readily be understood, the invention is not limited to the embodiments which have been described by way of example in the foregoing and a number of different alternative forms can accordingly be contemplated without thereby departing either from the scope or the spirit of the invention.

I claim:

1. An oblique-displacement sliding door comprising a stationary frame and at least one sliding leaf associated with guiding means attached to the frame for engaging the leaf transversely within the frame in the closed position and for disengaging said leaf in the opposite direction at the beginning of the opening movement, operating means for producing action on said leaf in the direction of sliding motion, a leaf-stabilizing system in which provision is made on the leaf for two separate toothed racks which are parallel to the direction of sliding motion and each associated with a pinion supported by a carriage retained by a guide which is parallel to said toothed rack, the two pinions aforesaid being coupled by means of a coordinating shaft which is placed transversely with respect to the guides, and two articulated stabilizing crank-arms each connected at one end to a carriage and at the other end to the door-frame, the axes of the two articulations for pivotally mounting the crank-arms on the door-frame being substantially coincident and parallel to the coordinating shaft, the operating means being such as to comprise a motor and a mechanism for driving the pinions of the leaf-stabilizing system in rotation, the aforementioned motor and drive mechanism being rigidly fixed to at least one of the two crank-arms which are pivotally mounted on the door-frame, wherein the motor for driving the pinions of the leaf-stabilizing system is a rotary motor associated with an auxiliary pinion disposed in meshing engagement with one of the aforementioned pinions.

2. A door according to claim 1, wherein the drive motor and the auxiliary pinion are mounted coaxially in parallel relation to the coordinating shaft and secured to a tube for connecting the stabilizing crank-arms which surround the aforementioned shaft, at least one of the means for securing the drive motor and auxiliary pinion to the connecting shaft being constituted by one of the aforementioned stabilizing crank-arms.

3. A door according to claim 1, wherein the rotary motor comprises a linear reciprocating-motion jack controlled by a pressurized-fluid circuit and associated with a motion converter for driving the auxiliary pinion in rotation.

4. A door according to claim 3, wherein the motion converter associated with the linear-motion jack is combined with a multiplier for effecting multiplication of the number of turns of the auxiliary pinion.

5. A door according to claim 3, wherein the motion converter and the multiplier are housed axially within the cylindrical body of the jack and comprise two rods which have threaded portions of reverse pitch and are coaxial with the jack body, the length of each rod being substantially one-half the length of the jack body and disposed in meshing engagement with a nut fixed within a piston which is traversed by the threaded rod and slidably mounted within the jack body, the two pistons each associated with one threaded rod being rigidly connected by means of an intermediate tube which surrounds the rods within the jack body and has a length substantially equal to one-half the length of said body, one end of a first rod being rigidly fixed to the jack body whereas the other end is rotatably mounted on one end of the second rod, the other end of said second rod being rotatably mounted within the jack body and adapted to extend through said body to the auxiliary pinion which is in mesh with the pinion of the leaf-stabilizing system.

* * * * *